US006149017A

United States Patent [19]

Manka

[11] Patent Number: 6,149,017

[45] Date of Patent: Nov. 21, 2000

[54] SOLID WASTE SORTING DEVICE

[76] Inventor: Robert-Marco Manka, Brüdergasse 2, D-53111 Bonn, Germany

[21] Appl. No.: 09/230,604

[22] PCT Filed: Dec. 4, 1996

[86] PCT No.: PCT/IB96/01351

§ 371 Date: May 19, 1999

§ 102(e) Date: May 19, 1999

[87] PCT Pub. No.: WO98/24562

PCT Pub. Date: Jun. 11, 1998

[51] Int. Cl.[7] ..... B07C 7/00

[52] U.S. Cl. ..... 209/630; 209/705; 209/930; 209/942

[58] Field of Search ..... 209/630, 702, 209/705, 930, 933, 942

[56] References Cited

U.S. PATENT DOCUMENTS 5,205,417 4/1993 Herren ..... 209/705 X 5,263,591 11/1993 Taormina et al. ..... 209/630

FOREIGN PATENT DOCUMENTS 694 343 1/1996 European Pat. Off. .

93 01 463 U 4/1993 Germany .

44 07 660 10/1995 Germany .

W0 86 03444 6/1986 WIPO .

*Primary Examiner*—Tuan N. Nguyen

*Attorney, Agent, or Firm*—Law Offices of Jane Massey Licata

[57] ABSTRACT

A station for sorting solid waste is provided with at least one transportation belt located outside of a waste loading and unloading zone and situated in a room of a superstructure mounted on a platform, an impervious housing inside the superstructure with at least one pair of openings and a control window, a pair of sleeves ending in gloves which seal the openings of the impervious housing and fit the arms and hands of a person doing the waste sorting, and dumping points inside the impervious housing which are allocated to one sorting person and are arranged on both sides of the transportation belt.

5 Claims, 2 Drawing Sheets

SOLID WASTE SORTING DEVICE

The present invention relates to an arrangement for sorting solid waste, especially domestic waste.

Solid waste is a mixture of various materials, e.g. metal, glass, plastics, wood, and compostable organic material.

Modern process techniques for waste recycling are waste material-specific and thus require a base material free from foreign substances, which must be provided by a sorting of the waste.

The separation of the individual components or material groups is carried out by means of arrangements for sorting solid waste, whereby the human factor plays a decisive role in this process because humans are unsurpassable with regard to their ability to differentiate and their precision in non-repeatable activities.

Arrangements for sorting solid waste, especially domestic waste, and the use of these arrangements are known. These arrangements comprise a transportation belt as conveyor belt of the tension means conveyor. This transportation belt is especially that part of the conveyor belt which, at any point in time, with regard to its position, transports the material to be conveyed - the waste. The part of the conveyor belt outside of the waste loading and unloading zone is situated in a room in a superstructure mounted on a platform, under which portable or fixed containers are arranged. Above each container, there is an ejection opening in the superstructure (in the platform) through which the sorted-out materials can be thrown into the containers. The room in the superstructure is equipped with a suction ventilation which eliminates the solid and gaseous particles escaping from the waste.

In spite of the employed ventilation, the persons sorting the waste must wear protective masks to protect their respiratory tracts against the inhalation of impurities. Thick protective clothing must be worn which is resistant to the influence of the compounds contained in the waste. The use of protective masks does not, however, sufficiently prevent the invasion of impurities into the body. An infection with microbes pathogenic to humans is also insufficiently prevented.

In addition, breathing through a face mask is always arduous and increases the degree of tiring, as does working in protective clothing.

The arrangement for sorting solid waste according to the invention comprises a transportation belt which constitutes that part of the carrier element or carrier unit of the tension means conveyor, e.g. the conveyor belt of the group of plates or chutes, which, at any point in time, with regard to its position, can transport or transports the material to be conveyed—the waste. A part of the transportation belt outside of the waste loading and unloading zone—these zones are located in the area of the end sections of the transportation belt—is situated in the room in the superstructure, which is mounted on a platform. At least one container for sorted-out waste is arranged under the platform and, simultaneously, under the dumping point. The term dumping point comprises one or more dumping points in the floor of the superstructure (i.e. in the platform), regardless of their shape, for the purpose of throwing in the sorted-out waste.

The arrangement is characterized in that the part of the transportation belt situated in the room in the superstructure, including the dumping point, is separated from the room by means of an impervious housing. The housing has at least one control window for the operators, i.e. the persons who do the sorting, whereby these windows can take up any amount of the surface of the housing. The housing is embodied with at least one pair of openings, sealed by means of sleeves ending in gloves.

The arrangement advantageously contains a second transportation belt, whereby the parts of the two transportation belts situated in the room of the superstructure, including the dumping point, are imperviously separated from the room of the superstructure by means of a shared housing.

In the technical solution with two transportation belts, a separating wall is advantageously mounted between their parts which are situated in the room of the superstructure. This separating wall enables the person (or persons) separating the waste to throw the removed waste not only in backward direction, towards himself—against the housing and on to the dumping point, but also forward towards the separating wall and into the dumping point. The separating wall thus serves the same purpose—with regard to the sorting activities—as the opposite wall of the housing in the technical solution with one transportation belt.

Figure 1:
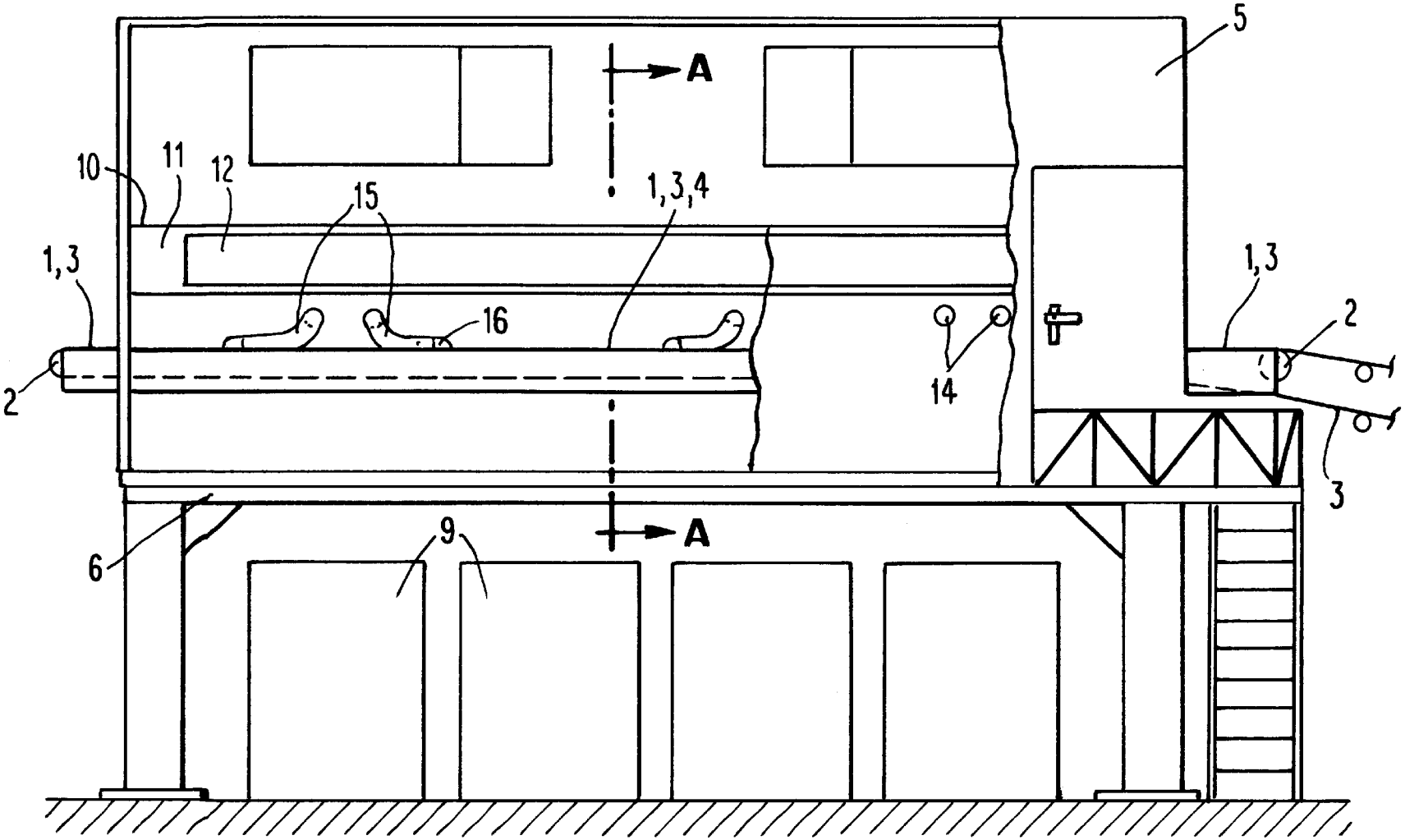
FIG. 1 shows a side view of the arrangement for sorting with a partially covered wall of the superstructure and a cut-out section in the housing.
Figure 2:
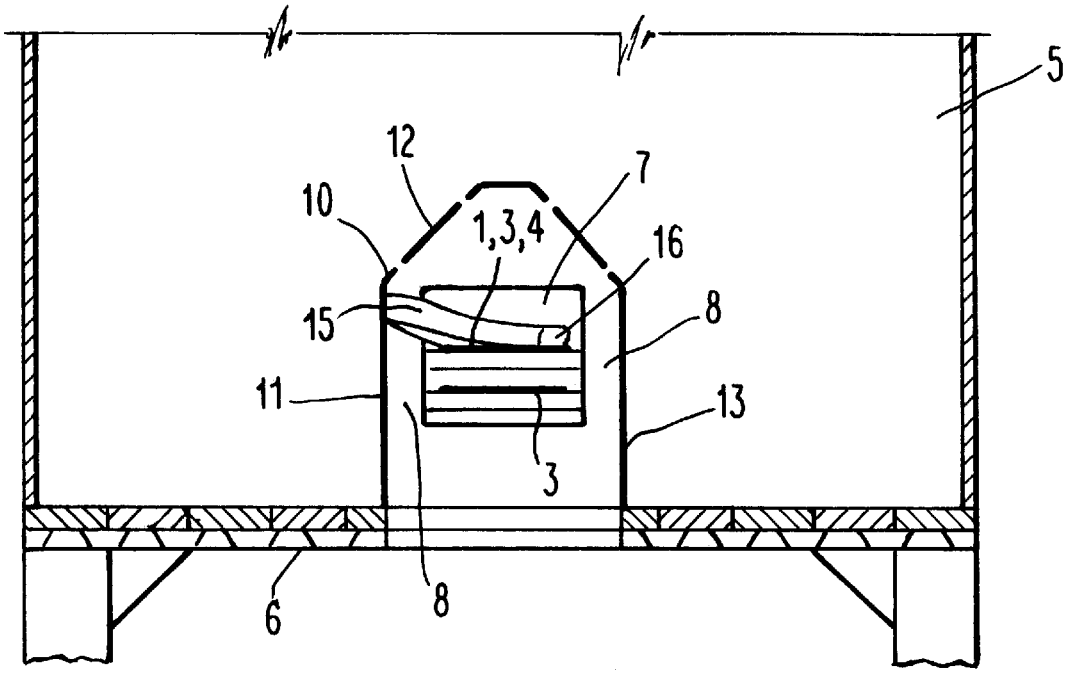
FIG. 2 shows a cross-sectional view A—A of the arrangement with one transportation belt as shown in FIG. 1.

The arrangement (FIG. 1 and FIG. 2) comprises a transportation belt 1 which forms the upper part—above the rollers 2—of the conveyor belt 3 of the tension means conveyor. Part 4 of the transportation belt 1, outside of the waste loading and unloading zone, is situated in the room of the superstructure mounted on a platform 6. The transportation belt 1 enters the superstructure 5 and exits the same through the opening 7 which is embodied at its two opposite walls. Containers 9 for sorted-out waste are arranged under the platform 6 and simultaneously under the dumping point 8.

The part 4 of the transportation belt 1 which is located between the opposite walls of the superstructure 5, as well as the dumping point 8, are imperviously separated from the room of the superstructure 5 by means of a housing 10.

Each of the side walls 11 of the housing 10 has pairs of openings 14, sealed by means of sleeves 15 ending in gloves 16.

Figure 3:
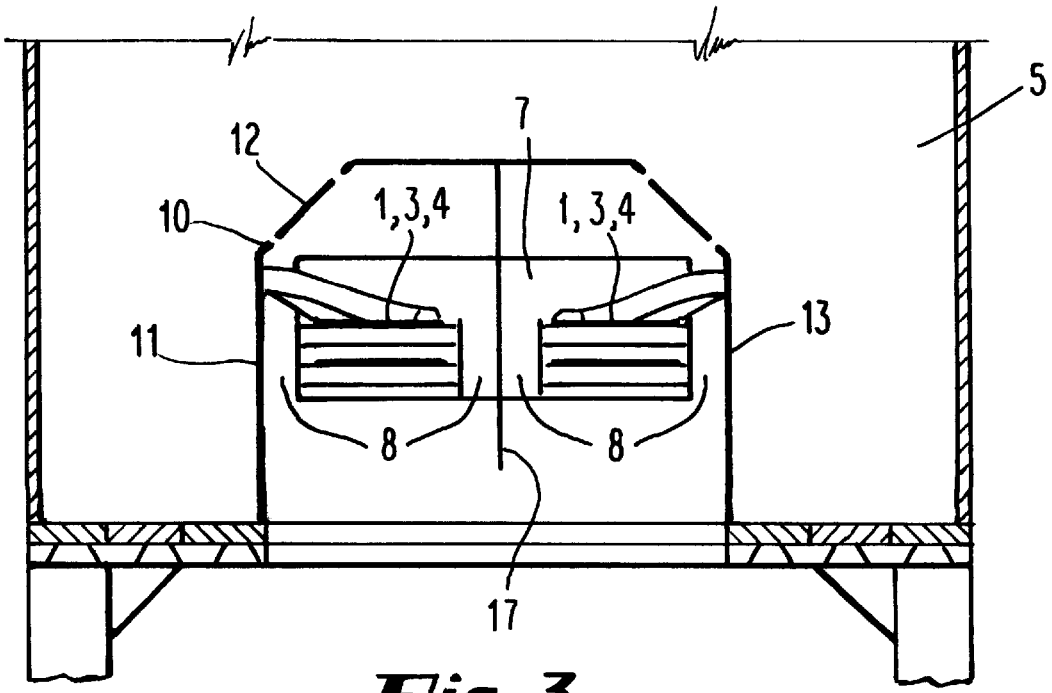
FIG. 3 shows a cross-sectional view of the arrangement with two transportation belts.

The arrangement (FIG. 3) comprising two transportation belts 1, the parts 4 of which are situated in the room of the superstructure 5 and covered by means of a shared superstructure 10, is equipped with a separating wall 17 which is arranged between the parts 4 of the transportation belts 1.

The separating wall 17 serves the same purpose—with regard to the sorting activities—as the opposite walls 11 and 13 of the housing 10 in the technical solution with one transportation belt 1, concerning each sorting station: the removed waste parts can be thrown against this wall and thus into the dumping point without the possibility of these falling onto the adjacent transportation belt 1.

In both the arrangement with one transportation belt 1 and the arrangement with two transportation belts 1, the person doing the sorting can throw the removed waste parts in the direction towards himself—i.e. against the wall 11 and 13.

What is claimed is:

1. A station for sorting solid waste comprising:

(a) at least one transportation belt with two sides, said transportation belt being located outside of a waste loading and unloading zone and situated in a room of a superstructure mounted on a platform;

(b) an impervious housing inside the superstructure with at least one pair of openings and a control window;

(c) a pair of sleeves ending in gloves which seal the openings of the impervious housing and fit the arms and hands of a person doing the solid waste sorting; and (d) dumping points inside the impervious housing which are allocated to one sorting person and are arranged on both sides of the transportation belt.

2. The station of claim 1 further comprising a second transportation belt also located in the room of the superstructure, wherein both transportation belts are separated from the room of the superstructure via a shared housing and wherein the dumping points are arranged between both transportation belts.

3. The station of claim 2 further comprising a separating wall arranged between the transportation belts wherein the dumping points are arranged between the transportations belts and the separating wall.

4. The station of claim 3 wherein the transportation belts are situated inside the impervious housing.

5. The station of claim 4 further comprising a transportation table wherein the transportation belts and transportation table together have a thickness of less than 5 cm.

* * * * *